US008889610B2

(12) United States Patent
Labeque et al.

(10) Patent No.: US 8,889,610 B2
(45) Date of Patent: Nov. 18, 2014

(54) SOLUBLE UNIT DOSE ARTICLES COMPRISING A CATIONIC POLYMER

(75) Inventors: Regine Labeque, Brussels (BE); Peter Jos Emma Van Ginderen, Aartselaar (BE); Marc Jennewein, Taunusstein (DE)

(73) Assignee: The Procter & Gamble Company, Cincinnati, OH (US)

( * ) Notice: Subject to any disclaimer, the term of this patent is extended or adjusted under 35 U.S.C. 154(b) by 53 days.

(21) Appl. No.: 13/159,466

(22) Filed: Jun. 14, 2011

(65) Prior Publication Data

US 2011/0319311 A1 Dec. 29, 2011

(30) Foreign Application Priority Data

Jun. 24, 2010 (EP) ..... 10167234

(51) Int. Cl.

| | |
|---|---|
| ***C11D 17/04*** | (2006.01) |
| ***C11D 3/22*** | (2006.01) |
| ***C11D 3/37*** | (2006.01) |
| ***C11D 10/04*** | (2006.01) |
| ***C11D 3/20*** | (2006.01) |
| ***C11D 9/22*** | (2006.01) |
| ***C11D 17/00*** | (2006.01) |

(52) U.S. Cl.

CPC ..... *C11D 17/0004* (2013.01); *C11D 10/04* (2013.01); *C11D 3/227* (2013.01); *C11D 3/2079* (2013.01); *C11D 3/3723* (2013.01); *C11D 9/225* (2013.01); *C11D 17/043* (2013.01); *C11D 3/3773* (2013.01)

USPC ..... 510/296; 510/338; 510/407; 510/418; 510/437; 510/473; 510/475

(58) Field of Classification Search

CPC ..... C11D 17/0004; C11D 17/043; C11D 3/2079; C11D 3/227; C11D 3/3773; C11D 10/04

USPC ..... 510/296, 321, 336, 338, 393, 404, 407, 510/418, 473, 437, 475

See application file for complete search history.

(56) References Cited

U.S. PATENT DOCUMENTS

| | | | | |
|---|---|---|---|---|
| 2,438,091 | A | 3/1948 | Lynch | |
| 2,528,378 | A | 10/1950 | Mannheimer | |
| 2,658,072 | A | 11/1953 | Kosmin | |
| 3,915,903 | A | 10/1975 | Wise | |
| 3,929,678 | A | 12/1975 | Laughlin et al. | |
| 4,234,627 | A | 11/1980 | Schilling | |
| 4,332,713 | A | 6/1982 | Lehmann | |
| 4,514,461 | A | 4/1985 | Woo | |
| 4,565,647 | A | 1/1986 | Llenado | |
| RE32,713 | E | 7/1988 | Woo | |
| 4,844,821 | A | 7/1989 | Mermelstein et al. | |
| 4,882,200 | A | 11/1989 | Liu et al. | |
| 4,882,220 | A | 11/1989 | Ono et al. | |
| 4,917,920 | A | 4/1990 | Ono et al. | |
| 5,225,112 | A * | 7/1993 | Miyazawa et al. | 510/124 |
| 5,714,457 | A * | 2/1998 | Kitsuki et al. | 510/499 |
| 5,942,217 | A | 8/1999 | Woo et al. | |
| 5,955,093 | A | 9/1999 | Woo et al. | |
| 5,968,404 | A | 10/1999 | Trinh et al. | |
| 6,033,679 | A | 3/2000 | Woo et al. | |
| 6,093,769 | A | 7/2000 | Burdick et al. | |
| 6,106,738 | A | 8/2000 | Woo et al. | |
| 6,126,954 | A | 10/2000 | Tsaur | |
| 6,200,949 | B1 | 3/2001 | Reijmer et al. | |
| 6,579,839 | B2 | 6/2003 | Price et al. | |
| 6,645,479 | B1 | 11/2003 | Shefer et al. | |
| 6,740,631 | B2 | 5/2004 | Shefer et al. | |
| 6,787,512 | B1 | 9/2004 | Verrall et al. | |
| 6,949,498 | B2 | 9/2005 | Murphy et al. | |
| 6,995,126 | B2 | 2/2006 | Perkis et al. | |
| 7,053,034 | B2 | 5/2006 | Shefer et al. | |
| 7,125,835 | B2 | 10/2006 | Bennett et al. | |
| 7,196,049 | B2 | 3/2007 | Brain et al. | |
| 7,238,655 | B2 | 7/2007 | Ness | |
| 7,585,824 | B2 | 9/2009 | Popplewell et al. | |
| 7,718,596 | B2 | 5/2010 | Briggs et al. | |
| 7,723,284 | B2 | 5/2010 | Mane et al. | |
| 7,737,103 | B2 | 6/2010 | Hloucha et al. | |
| 7,799,752 | B2 | 9/2010 | Ness et al. | |
| 2002/0187909 | A1 * | 12/2002 | Gupta et al. | 510/295 |
| 2003/0114332 | A1 | 6/2003 | Ramcharan et al. | |
| 2003/0158344 | A1 | 8/2003 | Rodriques et al. | |
| 2003/0165692 | A1 | 9/2003 | Koch et al. | |
| 2003/0203829 | A1 | 10/2003 | Shefer et al. | |
| 2003/0215417 | A1 | 11/2003 | Uchiyama et al. | |
| 2003/0216488 | A1 | 11/2003 | Uchiyama et al. | |
| 2004/0071742 | A1 | 4/2004 | Popplewell et al. | |
| 2004/0087477 | A1 | 5/2004 | Ness | |
| 2004/0106536 | A1 | 6/2004 | Mane et al. | |

(Continued)

FOREIGN PATENT DOCUMENTS

| | | | |
|---|---|---|---|
| EP | 0686691 | B1 | 8/2001 |
| WO | WO-89/09259 | A1 | 10/1989 |
| WO | WO 97/00936 | A1 | 1/1997 |
| WO | WO-98/08940 | A1 | 3/1998 |
| WO | WO 2007/107215 | A1 * | 9/2007 |
| WO | WO-2007/120547 | A1 | 10/2007 |
| WO | WO-2009/087034 | A1 | 7/2009 |

OTHER PUBLICATIONS

U.S. Appl. No. 13/159,445, filed Jun. 14, 2011, LaBeque.
U.S. Appl. No. 13/159,448, filed Jun. 14, 2011, LaBeque.
International Search Report, dated Nov. 24, 2010 (6 pages), EP10167234.3.

*Primary Examiner* — Lorna M Douyon
(74) *Attorney, Agent, or Firm* — Gregory S. Darley-Emerson; Steven W. Miller

(57) ABSTRACT

The need for a stable, quick dissolving unit dose article delivering good fabric care benefit is met by combining a cationic polymer with a fatty acid or salt in a non-aqueous composition, that is comprised within a water-soluble or dispersible film. By combining the cationic polymer with the fatty acid, the cationic polymer is prevented from reducing the solubility of the encapsulating film.

16 Claims, No Drawings

(56) References Cited

U.S. PATENT DOCUMENTS

| | | | | |
|---|---|---|---|---|
| 2004/0142840 | A1* | 7/2004 | de Buzzaccarini et al. | 510/296 |
| 2004/0152616 | A1* | 8/2004 | Murphy et al. | 510/475 |
| 2005/0076936 | A1 | 4/2005 | Pung et al. | |
| 2005/0081888 | A1 | 4/2005 | Pung et al. | |
| 2005/0124528 | A1* | 6/2005 | Binder et al. | 510/475 |
| 2006/0019866 | A1* | 1/2006 | Briggs et al. | 510/515 |
| 2006/0030513 | A1 | 2/2006 | Binder et al. | |
| 2006/0160921 | A1* | 7/2006 | Ragone et al. | 523/122 |
| 2006/0292184 | A1 | 12/2006 | Richardson et al. | |
| 2007/0107151 | A1 | 5/2007 | Pung et al. | |
| 2008/0242579 | A1* | 10/2008 | Briggs et al. | 510/296 |
| 2009/0069207 | A1* | 3/2009 | Panandiker et al. | 510/296 |
| 2009/0071369 | A1* | 3/2009 | Ragone et al. | 106/169.01 |
| 2009/0124528 | A1 | 5/2009 | Danziger et al. | |
| 2009/0172895 | A1 | 7/2009 | Lant et al. | |
| 2009/0209445 | A1* | 8/2009 | Panandiker et al. | 510/296 |
| 2010/0192986 | A1 | 8/2010 | Brooker et al. | |
| 2010/0313360 | A1 | 12/2010 | Menting et al. | |
| 2012/0167150 | A1 | 6/2012 | Le Scouarnec et al. | |

* cited by examiner

SOLUBLE UNIT DOSE ARTICLES COMPRISING A CATIONIC POLYMER

FIELD OF THE INVENTION

The present invention relates to stable, soluble, unit dose articles that deliver good fabric care benefit.

BACKGROUND OF THE INVENTION

Today's consumers desire an easy to use product for improved fabric care, delivering such benefits as: improved softness, reduced fabric wrinkles, less mechanical damage during washing, less colour fading, and less pills/fuzz. Cationic polymers are known in the Art for providing improved fabric care. Therefore, there is a strong desire to add such polymers to liquid unit dose articles that are quick to dissolve and readily disperse into solution. However, it has recently been discovered that adding such cationic polymers to liquid unit dose articles leads to poor solubility, since the cationic polymers can complex with the anionically charged water-soluble or dispersible film.

Accordingly, a need remains for a means to incorporate such cationic polymers into liquid unit dose articles, without interfering with the solubility of the enclosing film.

SUMMARY OF THE INVENTION

According to the present invention, there is provided a unit dose article containing a non-aqueous liquid composition comprising: a cationic polymer; and a fatty acid or salt; wherein the non-aqueous liquid composition is enclosed in a water-soluble or dispersible film. The present invention also provides for a process for preparing a unit dose article comprising the steps of: premixing the cationic polymer with the fatty acid or salt to form a cationic polymer/fatty acid premix; combining the cationic polymer/fatty acid or salt premix with a non-aqueous liquid feed to form the non-aqueous liquid composition; and encapsulating the non-aqueous liquid composition in a water soluble or dispersible film.

DETAILED DESCRIPTION OF THE INVENTION

The present invention relates to the use of cationic polymers for enhancing fabric care benefits. In particular, how to deliver such benefits, including improved softness, in an easy-to-use unit-dose form. The unit dose articles of the present invention comprise: a cationic polymer, and a fatty acid or salt, in a non-aqueous composition, encapsulated by a water-soluble or dispersible film. It has been surprisingly discovered that fatty acids and salts can prevent the cationic polymer from complexing with the water-soluble or dispersible film, and hence prevent the cationic polymer from reducing the film solubility. It is believed that, the cationic polymer preferentially complexes with the fatty acid or salt, and thus, is unable to associate with the film.

All percentages, ratios and proportions used herein are by weight percent of the encapsulated portion of the unit dose article (including that of multiple compartments where appropriate), unless otherwise specified. That is, excluding the weight of the encapsulating material.

Unit Dose Articles:

The non-aqueous liquid composition comprising the cationic polymer and fatty acid or salt is contained in a unit dose article, comprising at least one liquid-filled compartment. A liquid-filled compartment refers to a partition of the unit dose article comprising a liquid capable of wetting a fabric e.g., clothing. Such unit dose articles comprise, in single, easy to use dosage form: a cationic cellulose polymer and a cellulase enzyme, comprised in a non-aqueous composition, encapsulated in a water-soluble or dispersible film.

The unit dose article can be of any form, shape and material which is suitable for holding the non-aqueous composition, i.e. without allowing the release of the non-aqueous composition, and any additional component, from the unit dose article prior to contact of the unit dose article with water. The exact execution will depend, for example, on the type and amount of the compositions in the unit dose article, the number of compartments in the unit dose article, and on the characteristics required from the unit dose article to hold, protect and deliver or release the compositions or components.

The unit dose article comprises a water-soluble or dispersible film which fully encloses at least one inner volume, comprising the non-aqueous composition. The unit dose article may optionally comprise additional compartments comprising non-aqueous liquid and/or solid components. Alternatively, any additional solid component may be suspended in a liquid-filled compartment. A multi-compartment unit dose form may be desirable for such reasons as: separating chemically incompatible ingredients; or where it is desirable for a portion of the ingredients to be released into the wash earlier or later.

It may be preferred that any compartment which comprises a liquid component also comprises an air bubble. The air bubble may have a volume of less than 50%, preferably less than 40%, more preferably less than 30%, more preferably less than 20%, most preferably less than 10% of the volume space of said compartment. Without being bound by theory, it is believed that the presence of the air bubble increases the tolerance of the unit dose article to the movement of the liquid component within the compartment, thus reducing the risk of the liquid component leaking from the compartment.

Water-Soluble or Dispersible Film:

The water-soluble or dispersible film typically has a solubility of at least 50%, preferably at least 75%, more preferably at least 95%. The method for determining water-solubility of the film is given in the Test Methods. The water-soluble or dispersible film typically has a dissolution time of less than 100 seconds, preferably less than 85 seconds, more preferably less than 75 seconds, most preferably less than 60 seconds. The method for determining the dissolution time of the film is given in the Test Methods.

Preferred films are polymeric materials, preferably polymers which are formed into a film or sheet. The film can be obtained by casting, blow-moulding, extrusion or blow extrusion of the polymer material, as known in the art. Preferably, the water-soluble or dispersible film comprises: polymers, copolymers or derivatives thereof, including polyvinyl alcohols (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum, and mixtures thereof. More preferably, the water-soluble or dispersible film comprises: polyacrylates and water-soluble acrylate copolymers, methylcellulose, carboxymethylcellulose, dextrin, ethylcellulose, hydroxyethyl cellulose, hydroxypropyl methylcellulose, maltodextrin, polymethacrylates, and mixtures thereof. Most preferably, the water-soluble or dispersible film comprises: polyvinyl alcohols, polyvinyl alcohol copolymers, hydroxypropyl methyl cellulose (HPMC), and mixtures thereof.

Preferably, the level of polymer or copolymer in the film is at least 60% by weight. The polymer or copolymer preferably has a weight average molecular weight of from 1000 to 1,000,000, more preferably from 10,000 to 300,000, even more preferably form 15,000 to 200,000, and most preferably from 20,000 to 150,000.

Copolymers and mixtures of polymers can also be used. This may in particular be beneficial to control the mechanical and/or dissolution properties of the compartments or unit dose article, depending on the application thereof and the required needs. For example, it may be preferred that a mixture of polymers is present in the film, whereby one polymer material has a higher water-solubility than another polymer material, and/or one polymer material has a higher mechanical strength than another polymer material. Using copolymers and mixtures of polymers can have other benefits, including improved long-term resiliency of the water-soluble or dispersible film to the detergent ingredients. For instance, U.S. Pat. No. 6,787,512 discloses polyvinyl alcohol copolymer films comprising a hydrolyzed copolymer of vinyl acetate and a second sulfonic acid monomer, for improved resiliency against detergent ingredients. An example of such a film is sold by Monosol of Merrillville, Ind., US, under the brand name: M8900. It may be preferred that a mixture of polymers is used, having different weight average molecular weights, for example a mixture of polyvinyl alcohol or a copolymer thereof, of a weight average molecular weight of from 10,000 to 40,000, and of another polyvinyl alcohol or copolymer, with a weight average molecular weight of from 100,000 to 300,000.

Also useful are polymer blend compositions, for example comprising hydrolytically degradable and water-soluble polymer blends such as polylactide and polyvinyl alcohol, achieved by the mixing of polylactide and polyvinyl alcohol, typically comprising 1 to 35% by weight polylactide and from 65% to 99% by weight of polyvinyl alcohol. The polymer present in the film may be from 60% to 98% hydrolysed, more preferably from 80% to 90%, to improve the dissolution/dispersion of the film material.

The water-soluble or dispersible film herein may comprise additive ingredients other than the polymer or copolymer material. For example, it may be beneficial to add: plasticisers such as glycerol, ethylene glycol, diethyleneglycol, propylene glycol, sorbitol and mixtures thereof; additional water; and/or disintegrating aids.

Other suitable examples of commercially available water-soluble films include polyvinyl alcohol and partially hydrolysed polyvinyl acetate, alginates, cellulose ethers such as carboxymethylcellulose and methylcellulose, polyethylene oxide, polyacrylates and combinations of these. Most preferred are films with similar properties to the polyvinyl alcohol comprising film known under the trade reference M8630, sold by Monosol of Merrillville, Ind., US.

Non-Aqueous Liquid Compositions:

As used herein, "non-aqueous liquid composition" refers to any liquid composition comprising less than 20%, preferably less than 15%, more preferably less than 12%, most preferably less than 8% by weight of water. For instance, containing no additional water beyond what is entrained with other constituent ingredients. The term liquid also includes viscous forms such as gels and pastes. The non-aqueous liquid may include other solids or gases in suitably subdivided form, but excludes forms which are non-liquid overall, such as tablets or granules.

The non-aqueous composition of the present invention may also comprise from 2% to 40%, more preferably from 5% to 25% by weight of a non-aqueous solvent. As used herein, "non-aqueous solvent" refers to any organic solvent which contains no amino functional groups. Preferred non-aqueous solvents include monohydric alcohols, dihydric alcohols, polyhydric alcohols, glycerol, glycols including polyalkylene glycols such as polyethylene glycol, and mixtures thereof. More preferred non-aqueous solvents include monohydric alcohols, dihydric alcohols, polyhydric alcohols, glycerol, and mixtures thereof. Highly preferred are mixtures of solvents, especially mixtures of two or more of the following: lower aliphatic alcohols such as ethanol, propanol, butanol, isopropanol; diols such as 1,2-propanediol or 1,3-propanediol; and glycerol. Also preferred are propanediol and mixtures thereof with diethylene glycol where the mixture contains no methanol or ethanol. Thus embodiments of non-aqueous liquid compositions of the present invention may include embodiments in which propanediols are used but methanol and ethanol are not used.

Preferable non-aqueous solvents are liquid at ambient temperature and pressure (i.e. 21° C. and 1 atmosphere), and comprise carbon, hydrogen and oxygen. Non-aqueous solvents may be present when preparing a premix, or in the final non-aqueous composition.

Cationic Polymer:

The unit-dose articles of the present invention may comprise from 0.01% to 20%, preferably from 0.1% to 15%, more preferably from 0.6% to 10% by weight of the cationic polymer.

The cationic polymer preferably has a cationic charge density of from 0.005 to 23, more preferably from 0.01 to 12, most preferably from 0.1 to 7 milliequivalents/g, at the pH of the non-aqueous liquid composition. The charge density is calculated by dividing the number of net charges per repeating unit by the molecular weight of the repeating unit. The positive charges could be located on the backbone of the polymers and/or the side chains of polymers.

The term "cationic polymer" also includes amphoteric polymers that have a net cationic charge at the pH of the non-aqueous composition. Non-limiting examples of suitable cationic polymers are polysaccharides, proteins and synthetic polymers. Cationic polysaccharides include cationic cellulose derivatives, cationic guar gum derivatives, chitosan and derivatives and cationic starches. Suitable cationic polysaccharides include cationically modified cellulose, particularly cationic hydroxyethylcellulose and cationic hydroxypropylcellulose. Preferred cationic celluloses for use herein include those which may or may not be hydrophobically-modified, including those having hydrophobic substituent groups, having a molecular weight of from 50,000 to 2,000,000, more preferably from 100,000 to 1,000,000, and most preferably from 200,000 to 800,000. These cationic materials have repeating substituted anhydroglucose units that correspond to the general Structural Formula I as follows:

Structural Formula I

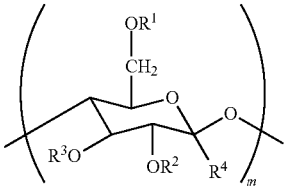

wherein:

a. m is an integer from 20 to 10,000 b. Each R4 is H, and $R^1$, $R^2$, $R^3$ are each independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, and

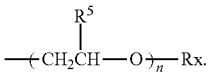

Preferably, $R^1$, $R^2$, $R^3$ are each independently selected from the group consisting of: H; and $C_1$-$C_4$ alkyl;

wherein:

n is an integer selected from 0 to 10 and

Rx is selected from the group consisting of: $R_5$;

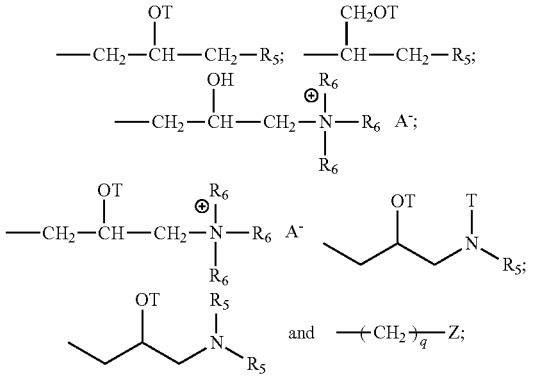

wherein at least one Rx in said polysaccharide has a structure selected from the group consisting of:

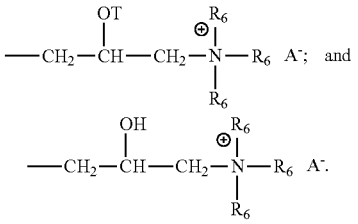

wherein $A^-$ is a suitable anion. Preferably, $A^-$ is selected from the group consisting of: $Cl^-$, $Br^-$, $I^-$, methylsulfate, ethylsulfate, toluene sulfonate, carboxylate, and phosphate;

Z is selected from the group consisting of carboxylate, phosphate, phosphonate, and sulfate.

q is an integer selected from 1 to 4;

each $R_5$ is independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, and OH. Preferably, each $R_5$ is selected from the group consisting of: H, $C_1$-$C_{32}$ alkyl, and $C_1$-$C_{32}$ substituted alkyl. More preferably, $R_5$ is selected from the group consisting of H, methyl, and ethyl.

Each $R_6$ is independently selected from the group consisting of: H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl. Preferably, each $R_6$ is selected from the group consisting of: H, $C_1$-$C_{32}$ alkyl, and $C_1$-$C_{32}$ substituted alkyl.

Each T is independently selected from the group: H,

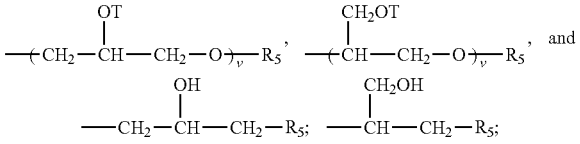

wherein each v in said polysaccharide is an integer from 1 to 10. Preferably, v is an integer from 1 to 5. The sum of all v indices in each Rx in said polysaccharide is an integer from 1 to 30, more preferably from 1 to 20, even more preferably from 1 to 10. In the last

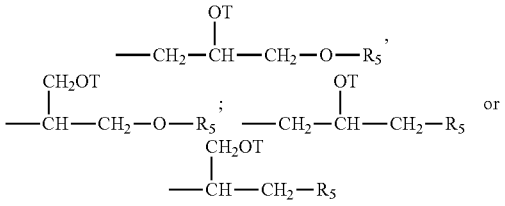

group in a chain, T is always an H.

Alkyl substitution on the anhydroglucose rings of the polymer may range from 0.01% to 5% per glucose unit, more preferably from 0.05% to 2% per glucose unit, of the polymeric material. The cationic cellulose may be lightly cross-linked with a dialdehyde, such as glyoxyl, to prevent forming lumps, nodules or other agglomerations when added to water at ambient temperatures. The cationic cellulose ethers of Structural Formula I likewise include those which are commercially available and further include materials which can be prepared by conventional chemical modification of commercially available materials. Commercially available cellulose ethers of the Structural Formula I type include those with the INCI name Polyquaternium 10, such as those sold under the trade names: Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name: Celquat H200 and Celquat L-200, available from National Starch and Chemical Company, Bridgewater, N.J. Other suitable polysaccharides include hydroxyethyl cellulose or hydroxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J. Cationic starches described by D. B. Solarek in Modified Starches, Properties and Uses published by CRC Press (1986) and in U.S. Pat. No. 7,135,451, col. 2, line 33-col. 4, line 67. Suitable cationic galactomannans include cationic guar gums or cationic locust bean gum. An example of a cationic guar gum is a quaternary ammonium derivative of Hydroxypropyl Guar such as those sold under the trade name: Jaguar C13 and Jaguar Excel available from Rhodia, Inc of Cranbury N.J. and N-Hance by Aqualon, Wilmington, Del.

A synthetic cationic polymer may also be useful as the cationic polymer. Synthetic polymers include synthetic addition polymers of the general structure:

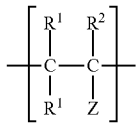

Structural Formula II wherein each $R^1$ may be independently: hydrogen, $C_1$-$C_{12}$ alkyl, substituted or unsubstituted phenyl, substituted or unsubstituted benzyl, —$OR_a$, or —$C(O)OR_a$ wherein $R_a$ may be selected from the group consisting of: hydrogen, $C_1$-$C_{24}$ alkyl, and combinations thereof. $R^1$ is preferably: hydrogen, $C_1$-$C_4$ alkyl, or —$OR_a$, or —$C(O)OR_a$;

wherein each $R^2$ may be independently selected from the group consisting of: hydrogen, hydroxyl, halogen, $C_1$-$C_{12}$ alkyl, —$OR_a$, substituted or unsubstituted phenyl, substituted or unsubstituted benzyl, carbocyclic, heterocyclic, and combinations thereof. $R^2$ is preferably selected from the group consisting of: hydrogen, $C_1$-$C_4$ alkyl, and combinations thereof.

Each Z may be independently: hydrogen, halogen; linear or branched $C_1$-$C_{30}$ alkyl, nitrilo, $N(R_3)_2$—$C(O)N(R_3)_2$; —NHCHO (formamide); —$OR^3$, —$O(CH_2)_nN(R^3)_2$, —$O(CH_2)_nN^+(R^3)_3X^-$, —$C(O)OR^4$; —$C(O)N$—$(R^3)_2$; —$C(O)O(CH_2)_nN(R^3)_2$, —$C(O)O(CH_2)_nN^+(R^3)_3X^-$, —$OCO(CH_2)_nN(R^3)_2$, —$OCO(CH_2)_nN^+(R^3)_3X^-$, —$C(O)NH$—$(CH_2)_nN(R^3)_2$, —$C(O)NH(CH_2)_nN^+(R^3)_3X^-$, —$(CH_2)_nN(R^3)_2$, —$(CH_2)_nN^+(R^3)_3X^-$.

Each $R_3$ may be independently selected from the group consisting of: hydrogen, $C_1$-$C_{24}$ alkyl, $C_2$-$C_8$ hydroxyalkyl, benzyl, substituted benzyl, and combinations thereof;

Each $R_4$ may be independently selected from the group consisting of: hydrogen, $C_1$-$C_{24}$ alkyl,

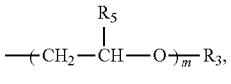

and combinations thereof.

X may be a water soluble anion. n may be from 1 to 6.

$R_5$ may be independently selected from the group consisting of: hydrogen, $C_1$-$C_6$ alkyl, and combinations thereof.

Z, from Structural Formula II, may also be selected from the group consisting of: non-aromatic nitrogen heterocycles containing a quaternary ammonium ion, heterocycles containing an N-oxide moiety, aromatic nitrogens containing heterocycles wherein one or more or the nitrogen atoms may be quaternized; aromatic nitrogen-containing heterocycles wherein at least one nitrogen may be an N-oxide, and combinations thereof. Non-limiting examples of addition polymerizing monomers comprising a heterocyclic Z unit includes 1-vinyl-2-pyrrolidinone, 1-vinylimidazole, quaternized vinyl imidazole, 2-vinyl-1,3-dioxolane, 4-vinyl-1-cyclohexene1,2-epoxide, and 2-vinylpyridine, 2-vinylpyridine N-oxide, 4-vinylpyridine 4-vinylpyridine N-oxide.

A non-limiting example of a Z unit which can be made to form a cationic charge in situ, may be the —NHCHO unit, formamide. The formulator can prepare a polymer, or co-polymer, comprising formamide units some of which are subsequently hydrolyzed to form vinyl amine equivalents.

The polymers or co-polymers may also contain one or more cyclic polymer units derived from cyclically polymerizing monomers. An example of a cyclically polymerizing monomer is dimethyl diallyl ammonium having the formula:

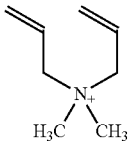

Suitable copolymers may be made from one or more cationic monomers selected from the group consisting of N,N-dialkylaminoalkyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl acrylate, quaternized N,N-dialkylaminoalkyl acrylamide, quaternized N,N-dialkylaminoalkylmethacrylamide, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole and derivatives, acrylic acid, methacrylic acid, maleic acid, vinyl sulfonic acid, styrene sulfonic acid, acrylamidopropylmethane sulfonic acid (AMPS) and their salts, and combinations thereof. The polymer may optionally be cross-linked. Suitable crosslinking monomers include ethylene glycoldiacrylate, divinylbenzene, butadiene.

In certain embodiments, the synthetic polymers are: poly (acrylamide-co-diallyldimethylammonium chloride), poly (acrylamide-methacrylamidopropyltrimethyl ammonium chloride), poly(acrylamide-co-N,N-dimethyl aminoethyl methacrylate), poly(acrylamide-co-N,N-dimethyl aminoethyl methacrylate), poly(hydroxyethylacrylate-co-dimethyl aminoethyl methacrylate), poly(hydroxpropylacrylate-co-dimethyl aminoethyl methacrylate), poly(hydroxpropylacrylate-co-methacrylamidopropyltrimethylammonium chloride), poly(acryl amide-co-diallyldimethylammonium chloride-co-acrylic acid), poly(acrylamide-methacrylamidopropyltrimethyl ammonium chloride-co-acrylic acid). Examples of other suitable synthetic polymers are Polyquatemium-1, Polyquaternium-5, Polyquaternium-6, Polyquaternium-7, Polyquaternium-8, Polyquatemium-11, Polyquaternium-14, Polyquaternium-22, Polyquaternium-28, Polyquaternium-30, Polyquaternium-32 and Polyquaternium-33. Other cationic polymers include polyethyleneamine and its derivatives and polyamidoamine-epichlorohydrin (PAE) Resins. In one aspect, the polyethylene derivative may be an amide derivative of polyetheylenimine sold under the trade name Lupasol SK. Also included are alkoxylated polyethylenimine; alkyl polyethyleneimine and quaternized polyethyleneimine. These polymers are described in Wet Strength resins and their applications edited by L. L. Chan, TAPPI Press (1994). The weight-average molecular weight of the polymer will generally be from 10,000 to 5,000,000, or from 100,000 to 200,000, or from 200,000 to 1,500,000 Daltons, as determined by size exclusion chromatography relative to polyethylene oxide standards with RI detection. The mobile phase used is a solution of 20% methanol in 0.4M MEA, 0.1 M $NaNO_3$, 3% acetic acid on a Waters Linear Ultrandyrogel column, 2 in series. Columns and detectors are kept at 40° C. Flow is set to 0.5 mL/min.

To further reduce any interaction between the cationic polymer and water-soluble or dispersible film, the non-aqueous liquid composition may comprise the cationic polymer, present in a particulate form. That is, the cationic polymer is insoluble in the non-aqueous liquid composition, or does not fully dissolve in the non-aqueous liquid composition. Suitable particulate forms include solids that are completely free of water and/or other solvent, but also includes solids that are partially hydrated and/or solvated. Partially hydrated or solvated particles are those that comprise water and/or another solvent at levels that are insufficient to cause the particles to fully solubilise. A benefit of partially hydrating and/or solvating the cationic polymer is that if any agglomerates form, they have low cake strength and are easy to redisperse. Such hydrated or solvated particles generally comprise from 0.5% to 50%, preferably 1% to 20% of water or solvent. While water is preferred, any solvent that is capable of partially solvating the cationic polymer may be used. The cationic polymer particles are preferably as small as possible. Suitable particles have an area average D90 diameter of less than 300 microns, preferably less than 200 microns, more preferably less than 150 microns. The area average D90 diameter is defined as 90% of the particles having an area smaller than the area of a circle having the diameter D90. The method for measuring the particle size is given in the Test Methods.

Fatty Acids:

In addition to the cationic polymer, the non-aqueous composition of the unit dose article may comprise from 0.2% to 40%, preferably from 0.5% to 30%, more preferably from 1% to 20% by weight of a fatty acid or its salt. Suitable fatty acids and salts include those having the formulation:

R1COOM wherein R1 is a primary or secondary alkyl group of 4 to 30 carbon atoms and M is a hydrogen cation or another solubilizing cation. While the acid (wherein M is a hydrogen cation) is suitable, the salt is preferred since it has a greater affinity for the cationic polymer. Therefore, the fatty acid or salt is preferably selected such that the pKa of the fatty acid or salt is less than the pH of the non-aqueous liquid composition. For this reason, the non-aqueous composition preferably has a pH of from 6 to 10.5, more preferably 6.5 to 9, most preferably 7 to 8.

The alkyl group represented by R1 may represent a mixture of chain lengths and may be saturated or unsaturated, although it is preferred that at least two thirds of the R1 groups have a chain length of between 8 and 18 carbon atoms. Non-limiting examples of suitable alkyl group sources include the fatty acids derived from coconut oil, tallow, tall oil and palm kernel oil. For the purposes of minimizing odor, however, it is often desirable to use primarily saturated carboxylic acids. The solubilizing cation, M, may be any cation that confers water solubility to the product, although monovalent moieties are generally preferred. Examples of acceptable solubilizing cations for use with this invention include alkali metals such as sodium and potassium, which are particularly preferred, and amines such as triethanolammonium, ammonium and morpholinium. Although, when used, the majority of the fatty acid should be incorporated into the non-aqueous composition in neutralized salt form, it is often preferable to leave an amount of free fatty acid in the composition, as this can aid in the maintenance of the viscosity of the non-aqueous composition.

The ability of the fatty acid or salt to prevent the cationic polymer from complexing with the water-soluble or dispersible film is dependent on the fatty acid level. When little or no fatty acid is present, the cationic polymer is fully able to complex with the water-soluble or dispersible film. Such films have poor solubility, leading to undesirable film residues on the fabric, after the wash. When the non-aqueous liquid composition comprises high fatty acid levels, the film dissolves too readily; and can even begin to dissolve after contact with wet hands or surfaces.

Therefore, by adjusting the fatty acid level, the solubility of the film can be tuned. For instance, to balance how readily the encapsulating film dissolves, with the susceptibility to leakage due to contact with wet hands and surfaces. In addition, through such a means, a broader range of films may be utilized for unit dose articles of the present invention, including lower cost, more soluble films. Such films would normally be unacceptable since they are prone to leakage and messy residue, upon contact with wet hands and surfaces. However, since the film solubility, for cationic polymer comprising unit dose articles, can be tuned using the fatty acid level, the problem of leakage and messiness due to contact with wet hands and surfaces can be eliminated.

Laundering Adjuncts:

The unit dose articles of the present invention may include conventional laundry detergent ingredients selected from the group consisting of: anionic and nonionic surfactants, additional surfactants, enzymes, enzyme stabilizers, amphiphilic alkoxylated grease cleaning polymers, clay soil cleaning polymers, soil release polymers, soil suspending polymers, bleaching systems, optical brighteners, hueing dyes, particulate material, perfume and other odour control agents, hydrotropes, suds suppressors, fabric care benefit agents, pH adjusting agents, dye transfer inhibiting agents, preservatives, non-fabric substantive dyes and mixtures thereof. Some of the optional ingredients which can be used are described in greater detail as follows:

Anionic and Nonionic Surfactants:

The unit dose articles of the present invention may comprise from 1% to 70%, preferably from 10% to 50%, and more preferably from 15% to 45% by weight of an anionic and/or nonionic surfactant.

The unit dose articles of the present invention preferably comprise from 1 to 70%, more preferably from 5 to 50% by weight of one or more anionic surfactants. Preferred anionic surfactant are selected from the group consisting of: C11-C18 alkyl benzene sulfonates, C10-C20 branched-chain and random alkyl sulfates, C10-C18 alkyl ethoxy sulfates, mid-chain branched alkyl sulfates, mid-chain branched alkyl alkoxy sulfates, C10-C18 alkyl alkoxy carboxylates comprising 1-5 ethoxy units, modified alkylbenzene sulfonate, C12-C20 methyl ester sulfonate, C10-C18 alpha-olefin sulfonate, C6-C20 sulfosuccinates, and mixtures thereof. However, by nature, every anionic surfactant known in the art of detergent compositions may be used, such as those disclosed in "Surfactant Science Series", Vol. 7, edited by W. M. Linfield, Marcel Dekker. However, the unit dose articles of the present invention preferably comprise at least one sulphonic acid surfactant, such as a linear alkyl benzene sulphonic acid, or the water-soluble salt forms.

Anionic sulfonate or sulfonic acid surfactants suitable for use herein include the acid and salt forms of linear or branched C5-C20, more preferably C10-C16, most preferably C11-C13 alkylbenzene sulfonates, C5-C20 alkyl ester sulfonates, C6-C22 primary or secondary alkane sulfonates, C5-C20 sulfonated polycarboxylic acids, and mixtures thereof. The aforementioned surfactants can vary widely in their 2-phenyl isomer content. Anionic sulphate salts suitable for use in compositions of the invention include: primary and secondary alkyl sulphates, having a linear or branched alkyl or alkenyl moiety having from 9 to 22 carbon atoms, more preferably from 12 to 18 carbon atoms; beta-branched alkyl sulphate surfactants; and mixtures thereof. Mid-chain branched alkyl sulphates or sulfonates are also suitable anionic surfactants for use in the compositions of the invention. Preferred are the $C_5$-$C_{22}$, preferably C10-C20 mid-chain branched alkyl primary sulphates. When mixtures are used, a suitable average total number of carbon atoms for the alkyl moieties is preferably within the range of from 14.5 to 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used. Other suitable anionic surfactants for use herein include fatty methyl ester sulphonates and/or alkyl ethoxy sulphates (AES) and/or alkyl polyalkoxylated carboxylates (AEC). Mixtures of anionic surfactants can be used, for example mixtures of alkylbenzenesulphonates and AES.

The anionic surfactants are typically present in the form of their salts with alkanolamines or alkali metals such as sodium and potassium. Preferably, the anionic surfactants are neutralized with alkanolamines, such as monoethanolamine or triethanolamine, and are fully soluble in the non-aqueous liquid composition.

The unit dose articles of the present invention may include from 1 to 70%, preferably from 5 to 50% by weight of a nonionic surfactant. Suitable nonionic surfactants include, but are not limited to C12-C18 alkyl ethoxylates ("AE") including the so-called narrow peaked alkyl ethoxylates, C6-C12 alkyl phenol alkoxylates (especially ethoxylates and mixed ethoxylates/propoxylates), block alkylene oxide condensate of C6-C12 alkyl phenols, alkylene oxide condensates of C8-C22 alkanols and ethylene oxide/propylene oxide block polymers (Pluronic®-BASF Corp.), as well as semi polar nonionics (e.g., amine oxides and phosphine oxides). An extensive disclosure of suitable nonionic surfactants can be found in U.S. Pat. No. 3,929,678.

Alkylpolysaccharides such as disclosed in U.S. Pat. No. 4,565,647 are also useful nonionic surfactants for compositions of the invention. Also suitable are alkyl polyglucoside surfactants. In some embodiments, suitable nonionic surfactants include those of the formula $R1(OC_2H_4)_nOH$, wherein R1 is a C10-C16 alkyl group or a C8-C12 alkyl phenyl group, and n is from 3 to 80. In some embodiments, the nonionic surfactants may be condensation products of C12-C15 alcohols with from 5 to 20 moles of ethylene oxide per mole of alcohol, e.g., C12-C13 alcohol condensed with 6.5 moles of ethylene oxide per mole of alcohol. Additional suitable nonionic surfactants include polyhydroxy fatty acid amides of the formula:

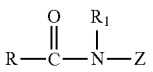

wherein R is a C9-C17 alkyl or alkenyl, R1 is a methyl group and Z is glycidyl derived from a reduced sugar or alkoxylated derivative thereof. Examples are N-methyl N-1-deoxyglucityl cocoamide and N-methyl N-1-deoxyglucityl oleamide.

Additional Surfactants

The unit dose articles of the present invention may comprise additional surfactant selected from the group consisting: anionic, cationic, nonionic, amphoteric and/or zwitterionic surfactants and mixtures thereof.

Suitable cationic surfactants can be water-soluble, water-dispersible or water-insoluble. Such cationic surfactants have at least one quaternized nitrogen and at least one long-chain hydrocarbyl group. Compounds comprising two, three or even four long-chain hydrocarbyl groups are also included. Examples include alkyltrimethylammonium salts, such as $C_{1-2}$ alkyltrimethylammonium chloride, or their hydroxyalkyl substituted analogues. The present invention may comprise 1% or more of cationic surfactants.

Amphoteric detersive surfactants suitable for use in the unit dose articles include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulphonate, sulphate, phosphate, or phosphonate. Suitable amphoteric detersive surfactants for use in the present invention include, but are not limited to: cocoamphoacetate, cocoamphodiacetate, lauroamphoacetate, lauroamphodiacetate, and mixtures thereof.

Zwitterionic detersive surfactants suitable for use in unit dose articles of the present invention are well known in the art, and include those surfactants broadly described as derivatives of aliphatic quaternary ammonium, phosphonium, and sulphonium compounds, in which the aliphatic radicals can be straight or branched chain, and wherein one of the aliphatic substituents contains from 8 to 18 carbon atoms and one contains an anionic group such as carboxy, sulfonate, sulphate, phosphate or phosphonate. Zwitterionics such as betaines are also suitable for this invention. Furthermore, amine oxide surfactants having the formula: $R(EO)_x(PO)_y(BO)_zN(O)(CH_2R')_2.qH2O$ are also useful in compositions of the present invention. R is a relatively long-chain hydrocarbyl moiety which can be saturated or unsaturated, linear or branched, and can contain from 8 to 20, preferably from 10 to 16 carbon atoms, and is more preferably C12-C16 primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by C12-C14 alkyldimethyl amine oxide.

Non-limiting examples of other anionic, zwitterionic, amphoteric or optional additional surfactants suitable for use in the compositions are described in McCutcheon's, Emulsifiers and Detergents, 1989 Annual, published by M. C. Publishing Co., and U.S. Pat. Nos. 3,929,678, 2,658,072; 2,438,091; 2,528,378.

Enzymes:

The unit dose articles of the present invention may comprise from 0.0001% to 8% by weight of a detersive enzyme which provides cleaning performance and/or fabric care benefits. Such compositions preferably have a composition pH of from 6 to 10.5. Suitable enzymes can be selected from the group consisting of: lipase, protease, amylase, cellulase, pectate lyase, xyloglucanase, and mixtures thereof. A preferred enzyme combination comprises a cocktail of conventional detersive enzymes such as lipase, protease, cellulase and amylase. Detersive enzymes are described in greater detail in U.S. Pat. No. 6,579,839.

Enzyme Stabilizers:

Enzymes can be stabilized using any known stabilizer system such as calcium and/or magnesium compounds, boron compounds and substituted boric acids, aromatic borate esters, peptides and peptide derivatives, polyols, low molecular weight carboxylates, relatively hydrophobic organic compounds [e.g. certain esters, dialkyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl) serine salts; (meth)acrylic acid-(meth)acrylic acid ester copolymer and PEG; lignin compound, polyamide oligomer, glycolic acid or its salts; poly hexamethylene biguanide or N,N-bis-3-amino-propyl-dodecyl amine or salt; and mixtures thereof.

Fabric Care Benefit Agents:

The unit dose article may comprise from 1% to 15%, more preferably from 2% to 7%, by weight of a fabric care benefit agent. "Fabric care benefit agent", as used herein, refers to any material that can provide fabric care benefits. Non-limiting examples of fabric care benefits include, but are not limited to: fabric softening, colour protection, colour restoration, pill/fuzz reduction, anti-abrasion and anti-wrinkling Non-limiting examples of fabric care benefit agents include: silicone derivatives, oily sugar derivatives, dispersible polyolefins, polymer latexes, cationic surfactants and combinations thereof.

Cleaning Polymers:

The unit dose article herein, may contain from 0.01% to 10%, preferably from 0.05% to 5%, more preferably from 0.1% to 2.0% by weight of cleaning polymers, that provide for broad-range soil cleaning of surfaces and fabrics. Any suitable cleaning polymer may be of use. Useful cleaning polymers are described in US 2009/0124528A1. Non-limiting examples of useful categories of cleaning polymers include: amphiphilic alkoxylated grease cleaning polymers; clay soil cleaning polymers; soil release polymers; and soil suspending polymers. Other anionic polymers, useful for improving soil cleaning include: non-silicone-containing polymers of natural origin, but also of synthetic origin. Suitable anionic non-silicone-containing polymers may be selected from the group consisting of xanthan gum, anionic starch, carboxymethyl guar, carboxymethyl hydroxypropyl guar, carboxy methyl cellulose and ester modified carboxymethyl cellulose, N-carboxyalkyl chitosan, N-carboxyalkyl chitosan amides, pectin, carrageenan gum, chondroitin sulfate, galactomanans, hyaluronic acid-, and alginic acid-based polymers, and derivatives thereof and mixtures thereof. More preferably, the anionic non-silicone-containing polymer maybe selected from carboxymethyl guar, carboxymethyl hydroxypropyl guar, carboxymethyl cellulose and xanthan gum, and derivatives and mixtures thereof. Preferred anionic non-silicone-containing polymers include those commercially available from CPKelco, sold under the tradename of Kelzan® RD and from Aqualon, sold under the tradename of Galactosol® SP722S, Galactosol® 60$H_3$FD, and Galactosol® 70H4FD.

Optical Brighteners:

These are also known as fluorescent whitenening agents for textiles. Preferred levels are from 0.001% to 2% by weight of the encapsulated portion of the unit dose article. Suitable brighteners are disclosed in EP 686691B and include hydrophobic as well as hydrophilic types. Brightener 49 is preferred for use in the present invention.

Hueing Dyes:

Hueing dyes or fabric shading dyes are useful laundering adjuncts in unit dose articles. Suitable dyes include blue and/or violet dyes having a hueing or shading effect. See, for example, WO 2009/087524 A1, WO2009/087034A1 and references therein. Recent developments that are suitable for the present invention include sulfonated phthalocyanine dyes having a zinc or aluminium central atom. The unit dose articles herein may comprise from 0.00003% to 0.1%, preferably from 0.00008% to 0.05% by weight of the fabric hueing dye.

Particulate Material:

The unit dose article may include additional particulate material such as clays, suds suppressors, encapsulated oxidation-sensitive and/or thermally sensitive ingredients such as perfumes (perfume microcapsules), bleaches and enzymes; or aesthetic adjuncts such as pearlescent agents including mica, pigment particles, or the like. Suitable levels are from 0.0001% to 10%, or from 0.1% to 5% by weight of the encapsulated portion of the unit dose article.

Perfume and Other Odour Control Agents:

In preferred embodiments, the unit dose article comprises a free and/or micro-encapsulated perfume. If present, the free perfume is typically incorporated at a level from 0.001 to 10%, preferably from 0.01% to 5%, more preferably from 0.1% to 3% by weight of the encapsulated portion of the unit dose article.

If present, the perfume microcapsule is formed by at least partially surrounding the perfume raw materials with a wall material. Preferably, the microcapsule wall material comprises: melamine crosslinked with formaldehyde, polyurea, urea crosslinked with formaldehyde or urea crosslinked with gluteraldehyde. Suitable perfume microcapsules and perfume nanocapsules include those described in the following references: US 2003215417 A1; US 2003216488 A1; US 2003158344 A1; US 2003165692 A1; US 2004071742 A1; US 2004071746 A1; US 2004072719 A1; US 2004072720 A1; EP 1393706 A1; US 2003203829 A1; US 2003195133 A1; US 2004087477 A1; US 20040106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; US RE 32713; U.S. Pat. No. 4,234,627.

In other embodiments, the unit dose article comprises odour control agents such as uncomplexed cyclodextrin, as described in U.S. Pat. No. 5,942,217. Other suitable odour control agents include those described in: U.S. Pat. No. 5,968,404, U.S. Pat. No. 5,955,093, U.S. Pat. No. 6,106,738, U.S. Pat. No. 5,942,217, and U.S. Pat. No. 6,033,679.

Hydrotropes:

The non-aqueous liquid composition of the unit dose article typically comprises a hydrotrope in an effective amount, preferably up to 15%, more preferably from 1% to 10%, most preferably from 3% to 6% by weight, so that the non-aqueous liquid compositions disperse readily in water. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, as disclosed in U.S. Pat. No. 3,915,903.

Multivalent Water-Soluble Organic Builder and/or Chelant:

The unit dose articles of the present invention may comprise from 0.6% to 25%, preferably from 1% to 20%, more preferably from 2% to 7% by weight of the multivalent water-soluble organic builder and/or chelants. Water-soluble organic builders provide a wide range of benefits including sequestration of calcium and magnesium (improving cleaning in hard water), provision of alkalinity, transition metal ion complexation, metal oxide colloid stabilisation, and provision of substantial surface charge for peptisation and suspension of other soils. Chelants may selectively bind transition metals (such as iron, copper and manganese) which impact stain removal and the stability of bleach ingredients, such as organic bleach catalysts, in the wash solution. Preferably, the multivalent water-soluble organic builder and/or chelants of the present invention are selected from the group consisting of: MEA citrate, citric acid, aminoalkylenepoly(alkylene phosphonates), alkali metal ethane 1-hydroxy disphosphonates, and nitrilotrimethylene, phosphonates, diethylene triamine penta (methylene phosphonic acid) (DTPMP), ethylene diamine tetra(methylene phosphonic acid) (DDTMP), hexamethylene diamine tetra(methylene phosphonic acid), hydroxy-ethylene 1,1 diphosphonic acid (HEDP), hydroxyethane dimethylene phosphonic acid, ethylene di-amine disuccinic acid (EDDS), ethylene diamine tetraacetic acid (EDTA), hydroxyethylethylenediamine triacetate (HEDTA), nitrilotriacetate (NTA), methylglycinediacetate (MGDA), iminodisuccinate (IDS), hydroxyethyliminodisuccinate (HIDS), hydroxyethyliminodiacetate (HEIDA), glycine diacetate (GLDA), diethylene triamine pentaacetic acid (DTPA), and mixtures thereof.

External Structuring System:

An external structuring system is a compound or mixture of compounds which provide either a sufficient yield stress or low shear viscosity to stabilize the non-aqueous liquid composition independently from, or extrinsic from, the structuring effect of any detersive surfactants in the composition. The non-aqueous liquid composition may comprise from 0.01% to 10%, preferably from 0.1% to 4% by weight of an external structuring system. Suitable external structuring systems include non-polymeric crystalline, hydroxy-functional structurants, polymeric structurants, or mixtures thereof.

Preferably, the external structurant system imparts a high shear viscosity at 20 $s^{-1}$, at 21° C., of from 1 to 1500 cps, and a viscosity at low shear (0.05 $s^{-1}$ at 21° C.) of greater than 5000 cps. The viscosity is measured using an AR 550 rheometer, from TA instruments, using a plate steel spindle with a 40 mm diameter and a gap size of 500 μm. The high shear viscosity at 20$s^{-1}$, and low shear viscosity at 0.5$s^{-1}$, can be obtained from a logarithmic shear rate sweep from 0.1$s^{-1}$ to 25$s^{-1}$ in 3 minutes time at 21° C.

The external structuring system may comprise from 0.01 to 1% by weight of a non-polymeric crystalline, hydroxyl functional structurant. Such non-polymeric crystalline, hydroxyl functional structurants generally comprise a crystallisable glyceride which can be pre-emulsified to aid dispersion into the final unit dose article. Preferred crystallisable glycerides include hydrogenated castor oil or "HCO", and derivatives thereof, provided that it is capable of crystallizing in the non-aqueous liquid composition. Other embodiments of suitable external structuring systems may comprise from 0.01 to 5% by weight of a naturally derived and/or synthetic polymeric structurant. Examples of suitable naturally derived polymeric structurants include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Examples of suitable synthetic polymeric structurants include: polycarboxylates, polyacrylates, hydrophobically modified ethoxylated urethanes, hydrophobically modified non-ionic polyols and mixtures thereof.

Process of Making:

Premixing the cationic polymer and fatty acid or salt, before combining with the other ingredients, further reduces the ability of the cationic polymer to complex with the water-soluble or dispersible film. Therefore, the present invention also provides for a preferred process of making a unit dose article, comprising the steps of: premixing the cationic polymer with the fatty acid or salt to form a premix of cationic polymer and fatty acid or salt; combining the cationic polymer/fatty acid premix with a non-aqueous liquid feed, to form the non-aqueous liquid composition; and encapsulating the non-aqueous liquid composition in a water soluble or dispersible film.

Test Methods:

1) pH Measurement:

The pH is measured on the neat composition, at 25° C., using a Santarius PT-10P pH meter with gel-filled probe (such as the Toledo probe, part number 52 000 100), calibrated according to the instruction manual.

2) Method of Measuring Particle Size:

The Occhio Flow Cell FC200-S (Angleur, Belgium) is used to measure the particle size distribution. The sample containing the particles to be analysed is diluted to 2% by weight, using PEG200, to ensure single particle detection. 2 ml of the diluted sample is analysed according to the instructions provided with the device.

3) Method of Measuring the Solubility of Water-Soluble or Dispersible Films:

5.0 grams±0.1 gram of the water-soluble or dispersible film is added in a pre-weighed 400 ml beaker and 245 ml±1 ml of distilled water is added. This is stirred vigorously on a magnetic stirrer set at 600 rpm, for 30 minutes. Then, the mixture is filtered through a sintered-glass filter with a pore size of maximum 20 microns. The water is dried off from the collected filtrate by any conventional method, and the weight of the remaining material is determined (which is the dissolved or dispersed fraction). Then, the percentage solubility or dispersibility can be calculated.

4) Method of Measuring the Dissolution Time of Water-Soluble or Dispersible Films:

The film is cut and mounted into a folding frame slide mount for 24 mm by 36 mm diapositive film, without glass (part number 94.000.07, supplied by Else, The Netherlands, however plastic folding frames from other suppliers may be used).

A standard 600 ml glass beaker is filled with 500 ml of city water at 10° C. and agitated using a magnetic stirring rod such that the bottom of the vortex is at the height of the 400 ml graduation mark on the beaker.

The slide mount is clipped to a vertical bar and suspended into the water, with the 36 mm side horizontal, along the diameter of the beaker, such that the edge of the slide mount is 5 mm from the beaker side, and the top of the slide mount is at the height of the 400 ml graduation mark. The stop watch is started immediately the slide mount is placed in the water, and stopped when the film fully dissolves. This time is recorded as the "film dissolution time".

EXAMPLES

Example 1 is a non-aqueous liquid composition of the present invention, comprising a cationic polymer (LK400) and a fatty acid. The unit-dose article of the present invention is formed by encapsulating the non-aqueous liquid composition in a polyvinyl alcohol film (M8630, supplied by Monosol). Comparative example 1 and comparative example 2 both comprise the same level of cationic polymer, but no fatty acid or salt. Comparative example 1 replaces the fatty acid with additional polyethylene glycol 200. Comparative example 2 comprises a mix of other anionic surfactants, nonionic surfactant, propanediol, and the cationic polymer, but contains no fatty acid. In all three examples, the cationic polymer was present in particulate form.

| Ingredient | Example 1 WT % | Comparative Example 1 WT % | Comparative Example 2 WT % |
|---|---|---|---|
| Cationic polymer (LK400) [1] | 15 | 15 | 15 |
| C12-18 Fatty Acid | 10 | — | — |
| C12-14 Alkyl 3-ethoxylated sulphate acid | — | — | 30 |
| C12-14 alkyl 7-ethoxylate | — | — | 30 |
| Pluriol E200 (Polyethylene glycol 200) | 75 | 85 | — |
| 1,2 propane diol | — | — | 45 |
| Dissolution time (seconds) | 114 s | 167 s | 3600 s |

[1] Supplied by Dow Chemicals

For the dissolution test, the polyvinyl alcohol film was first immersed in the respective non-aqueous liquid compositions for 2 weeks, at 35° C., with daily, manual, agitation.

From the comparison of the dissolution times of example 1 and comparative example 1, it can be seen that the fatty acid results in a 32% improvement in the dissolution time of the film. As can be seen from comparative example 2, the presence of propanediol, an anionic surfactant, and a nonionic surfactant did not improve the film solubility.

Example 2 to 7 are unit dose articles of the present invention comprising a cationic polymer (LK400) and a fatty acid in a non-aqueous liquid detergent composition, encapsulated in a polyvinyl alcohol film (M8630, supplied by Monosol).

| Ingredient name | Ex 2 WT % | Ex 3 WT % | Ex 4 WT % | Ex 5 WT % | Ex 6 WT % | Ex 7 WT % |
|---|---|---|---|---|---|---|
| Linear alkyl benzene sulfonic acid | 15.81 | 16 | 15 | 15 | 16 | 15 |
| C12-14 Alkyl 3-ethoxylated sulphate acid | 9.4 | 9.5 | 9 | 10 | 10 | 9 |
| C12-14 alkyl 7-ethoxylate | 13.84 | 13 | 15 | 15 | 14 | 13 |
| Citric acid | 0.66 | 0.66 | 0.66 | 0.66 | 0.66 | 0.66 |
| C12-18 Fatty Acid | 8.65 | 8 | 7 | 7 | 9 | 7 |
| DTPA (diethylene triamine pentaacetic acid) | 1.18 | 1.18 | 1.18 | 1.18 | 1.18 | 1.18 |
| Protease | 0.16 | 0.1 | 0.2 | 0.22 | 0.16 | 0.15 |
| LK400[1] | 0.51 | — | — | — | — | — |
| Polymer LR400[1] | — | 0.4 | — | — | — | — |
| Polymer JR30M[1] | — | — | 0.6 | 0.5[4] | — | — |
| Jaguar C13[2] | — | — | — | — | 0.55 | — |
| Lupasol SK[3] | — | — | — | — | — | 0.65[5] |
| Pluriol E200 (Polyethylenglycol 200) | — | — | — | 2.7[4] | — | 3[5] |
| Polyethyleneimine ethoxylate PEI600 E20 | 8 | 7 | 8 | 7 | 8 | 8 |
| PEG6000-PVAc/Polyethylene glycol 6000-Polyvinyl acetate copolymer | 4 | 3 | 3.5 | 4 | 3 | 3.5 |
| Monoethanol amine | To pH 7.5 | To pH 7.5 | To pH 7.5 | To pH 7.5 | To pH 7.5 | To pH 7.5 |
| 1,2-propanediol | 11 | 15 | 12 | 11 | 13 | 15 |
| Glycerol | 5 | 5 | 5 | 5 | 5 | 5 |
| Dye | 0.01 | 0.01 | 0.01 | 0.01 | 0.01 | 0.01 |
| Water | 10 | 8 | 9 | 10 | 10 | 10.5 |
| Miscellaneous/Minors | To 100 | To 100 | To 100 | To 100 | To 100 | To 100 |

[1]Supplied by Dow Chemicals
[2]Rhodia, Inc of Cranbury NJ
[3]BASF Corporation, North Mount Olive, NJ
[4]JR30M in particulate form, added as a suspension in the non-aqueous dispersant (Pluriol E200)
[5]Lupasol SK in particulate form, added as a suspension in the non-aqueous dispersant (Pluriol E200)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A unit dose article containing a non-aqueous liquid composition comprising:

a) from about 0.1% to about 15% by weight of a cationic polymer, wherein the cationic polymer is cationic hydroxyethylcellulose and is present in a particulate form;

b) from about 0.2% to about 40% by weight of a fatty acid or its salt;

c) from 0.01% to 10% by weight of an external structuring system selected from the group consisting of non-polymeric crystalline hydroxy-functional structurants, polymeric structurants, and mixtures thereof;

d) from 10% to 70% by weight of an anionic and/or nonionic surfactant; and e) a non-aqueous solvent;

wherein the non-aqueous liquid composition comprises less than about 15% by weight of water and is enclosed in a water-soluble or dispersible film.

2. The unit dose article according to claim 1, wherein the non-aqueous liquid composition comprises less than about 12% by weight of water.

3. The unit dose article according to claim 1, wherein the non-aqueous liquid composition comprises less than about 8% by weight of water.

4. The unit dose article according to claim 1, comprising from about 0.5% to about 30% by weight of the fatty acid or its salt.

5. The unit dose article according to claim 1, wherein the water-soluble or dispersible film comprises resin selected from the group consisting of: polyvinyl alcohols, polyvinyl alcohol copolymers, hydroxypropyl methyl cellulose (HPMC), and mixtures thereof.

6. The unit dose article of claim 1, wherein the non-aqueous liquid composition comprises anionic surfactant.

7. The unit dose article of claim 1, wherein the non-aqueous liquid composition comprises nonionic surfactant.

8. The unit dose article of claim 1, wherein the non-aqueous solvent comprises a polyalkylene glycol.

9. The unit dose article of claim 8, wherein the polyalkylene glycol is polyethylene glycol.

10. The unit dose article of claim 1, wherein the external structuring system is a crystallisable glyceride.

11. The unit dose article according to claim 1, comprising from about 0.6% to about 10% by weight of the cationic polymer.

12. The unit dose article according to claim 1, wherein the non-aqueous composition has a pH of from about 6 to about 10.5.

13. The unit dose article according to claim 1, wherein the non-aqueous composition has a pH of from about 6.5 to about 9.

14. The unit dose article according to claim 1, wherein the non-aqueous composition has a pH of from about 7 to about 8.

15. The unit dose article according to claim 1, wherein the unit dose article is a multi-compartment unit dose form.

16. A process for preparing the unit dose article of claim 1, characterized in that the process comprises the steps of:

a. premixing the cationic polymer with the fatty acid or salt to form a premix of the cationic polymer and fatty acid premix;

b. combining the cationic polymer/fatty acid or salt premix with a non-aqueous liquid feed to form the non-aqueous liquid composition; and c. encapsulating the non-aqueous liquid composition in a water soluble or dispersible film.

* * * * *